US005778499A

United States Patent [19]

Lehrman

[11] Patent Number: 5,778,499

[45] Date of Patent: Jul. 14, 1998

[54] SHOELACE AND METHOD FOR EASY TYING

[76] Inventor: Dena Lehrman, 43 Netzach Yerushalayim, Efrat 90435, Israel

[21] Appl. No.: 692,677

[22] Filed: Aug. 6, 1996

Related U.S. Application Data

[60] Provisional application No. 60/002,005 Aug. 7, 1995.

[51] Int. Cl.[6] ..... A43C 9/00

[52] U.S. Cl. ..... 24/712; 24/712.2; 24/713; 24/715.3

[58] Field of Search ..... 24/712, 712.2, 24/713, 713.6, 713.8, 714.3, 714.6, 714.7, 715.5, 715.7, 442, 306; 36/50.1

[56] References Cited

U.S. PATENT DOCUMENTS

| | | | |
|---|---|---|---|
| 2,306,515 | 12/1942 | Wright | 24/713 |
| 2,344,963 | 3/1944 | Benowitz | 24/712 |
| 3,683,520 | 8/1972 | Partagas | 24/712.2 |
| 4,247,967 | 2/1981 | Swinton | 24/306 |
| 4,721,468 | 1/1988 | Alexander et al. | 24/712 |
| 4,764,119 | 8/1988 | Miraglia | 24/712 |
| 4,879,787 | 11/1989 | Walls | 24/712.2 |
| 5,023,982 | 6/1991 | Mehan | 24/715.3 |
| 5,074,013 | 12/1991 | Arnold et al. | 24/713 |

*Primary Examiner*—Victor N. Sakran
*Attorney, Agent, or Firm*—Cooper & Dunham

[57] ABSTRACT

This invention provides a binding for facilitating tying a bow, comprising a binding having two end portions wherein a multiplicity of hook-shaped filaments are positioned on a first region of each end portion; and a second region of each end portion is adapted for adhering to the hook-shaped filaments positioned on the same end portion so as to form a loop at each end portion.

5 Claims, 7 Drawing Sheets

SHOELACE AND METHOD FOR EASY TYING

This application claims the benefit of U.S. Provisional Application No. 60/002,005, filed Aug. 7, 1995.

BACKGROUND OF THE INVENTION

Children are often taught to tie their shoelaces using the two-loop or "Bunny Ear" method, in the following manner:

Step 1: Pulling the separate laces, crossing them and then pulling one lace through the triangular opening while simultaneously pulling on the other lace. (FIG. 1A).

Step 2: Forming and maintaining the shape of two bunny ears (loops). (FIG. 1B).

Step 3: Crossing both loops forming a diamond shape opening (FIG. 1C).

Step 4: Completing the knot by pulling one loop thought the diamond shape opening while simultaneously pulling on the other loop. (FIG. 1D).

Children attempting to tie their own shoelaces within the developmental norms as well as with children learning this skill at a much later date for the most part are capable of learning the first two steps at a quick pace. Problems arise when they attempted to stabilize the loops while trying to manipulate them in order to complete the final stage (steps 3 and 4). The children were often frustrated as the loops often lost their shape and they often did not have the fine motor skills necessary for the successful completion of the task. Due to this frustration, both the children as well as their parents gave up on the acquisition of the skill, hoping to achieve it at a later date.

SUMMARY OF THE INVENTION

This invention provides a binding having two end portions wherein a multiplicity of hook-shaped filaments are positioned on a first region of each end portion; and a second region of each end portion is adapted for adhering to the hook-shaped filaments positioned on the same end portion so as to form a loop at each end portion.

DESCRIPTION OF THE INVENTION

FIG. 1A: Step 1 of the bunny ear method of shoe tying.

FIG. 1B: Step 2 of the bunny ear method of shoe tying.

FIG. 1C: Step 3 of the bunny ear method of shoe tying.

FIG. 1D: Step 4 of the bunny ear method of shoe tying.

FIG. 2: Shoelace with VELCRO hook pads located at one or both ends of the shoelace.

FIG. 3A: Shoe and shoelace of this invention showing loops almost formed. Of the two sections on either side of the shoelace which meet to form the loops, the VELCRO hook pad is on the portion of the shoelace which is proximal to the tips of the shoelace.

FIG. 3B: Same as FIG. 3A, except that the VELCRO hook pad is on the portion of the shoelace which is distal to the tips of the shoelace.

DETAILED DESCRIPTION OF THE INVENTION

This invention provides a shoelace which functions as a teaching tool for the individuals learning to tie their own shoelaces as well as a compensatory device for those individuals lacking the necessary fine motor or perceptual skills. The present invention provides a method for facilitating independent shoe tying for children who are learning this age appropriate skill as well as for enabling developmentally delayed children and handicapped adults to achieve the same milestone.

This invention provides a binding having two end portions wherein a multiplicity of hook-shaped filaments are positioned on a first region of each end portion; and a second region of each end portion is adapted for adhering to the hook-shaped filaments positioned on the same end portion so as to form a loop at each end portion.

This invention provides a binding having two end portions wherein a hook-shaped filament is positioned on a first region of an end portion; and a second region of the end portion is adapted for adhering to the hook-shaped filament positioned on the same end portion so as to form a loop at each end portion.

Preferably the hook-shaped filament comprises a VELCRO™ hook pad. In an embodiment of the binding, the second region comprises a multiplicity of hook shaped filaments.

Figure 3A:
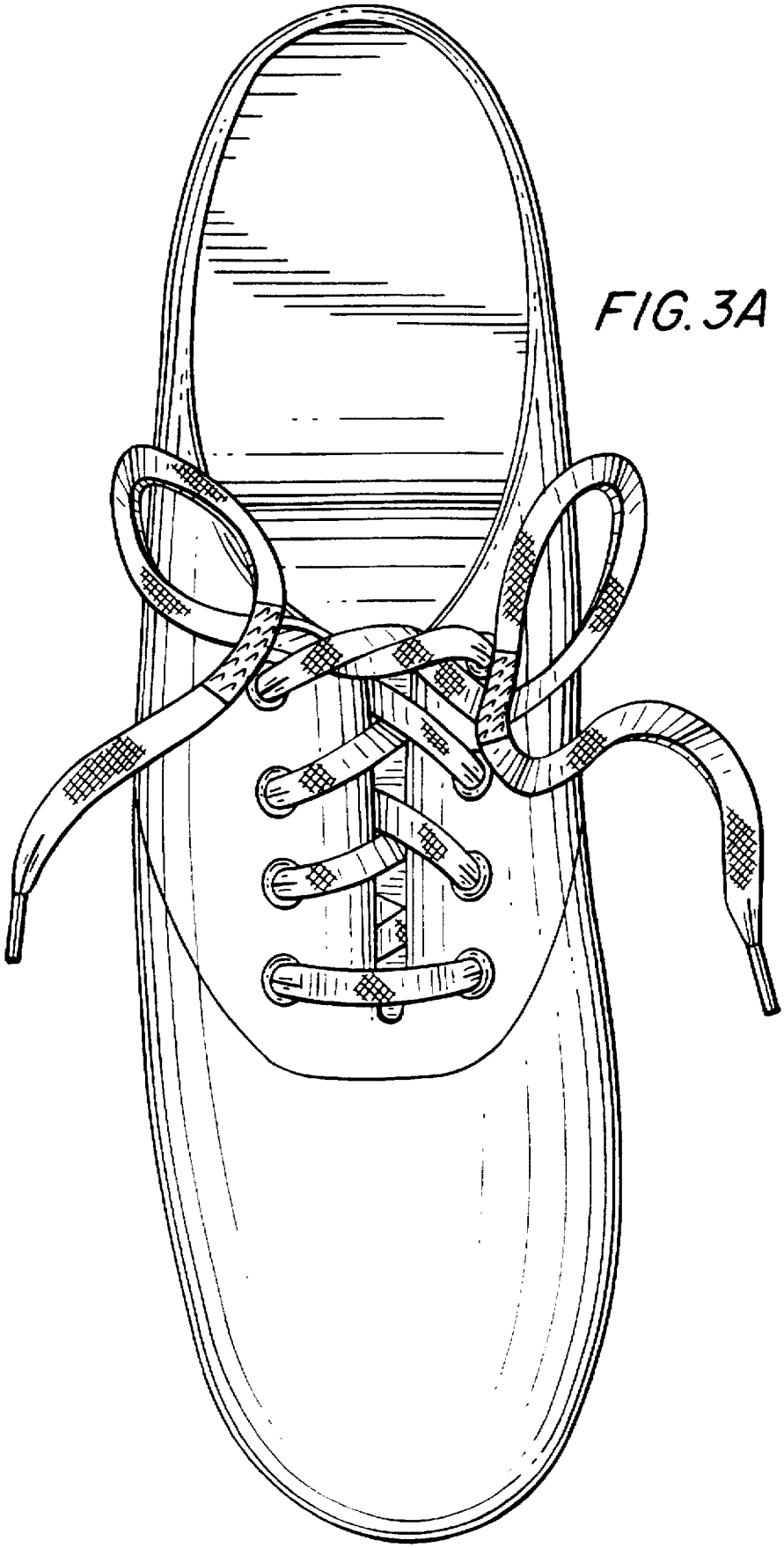
Figure 3B:
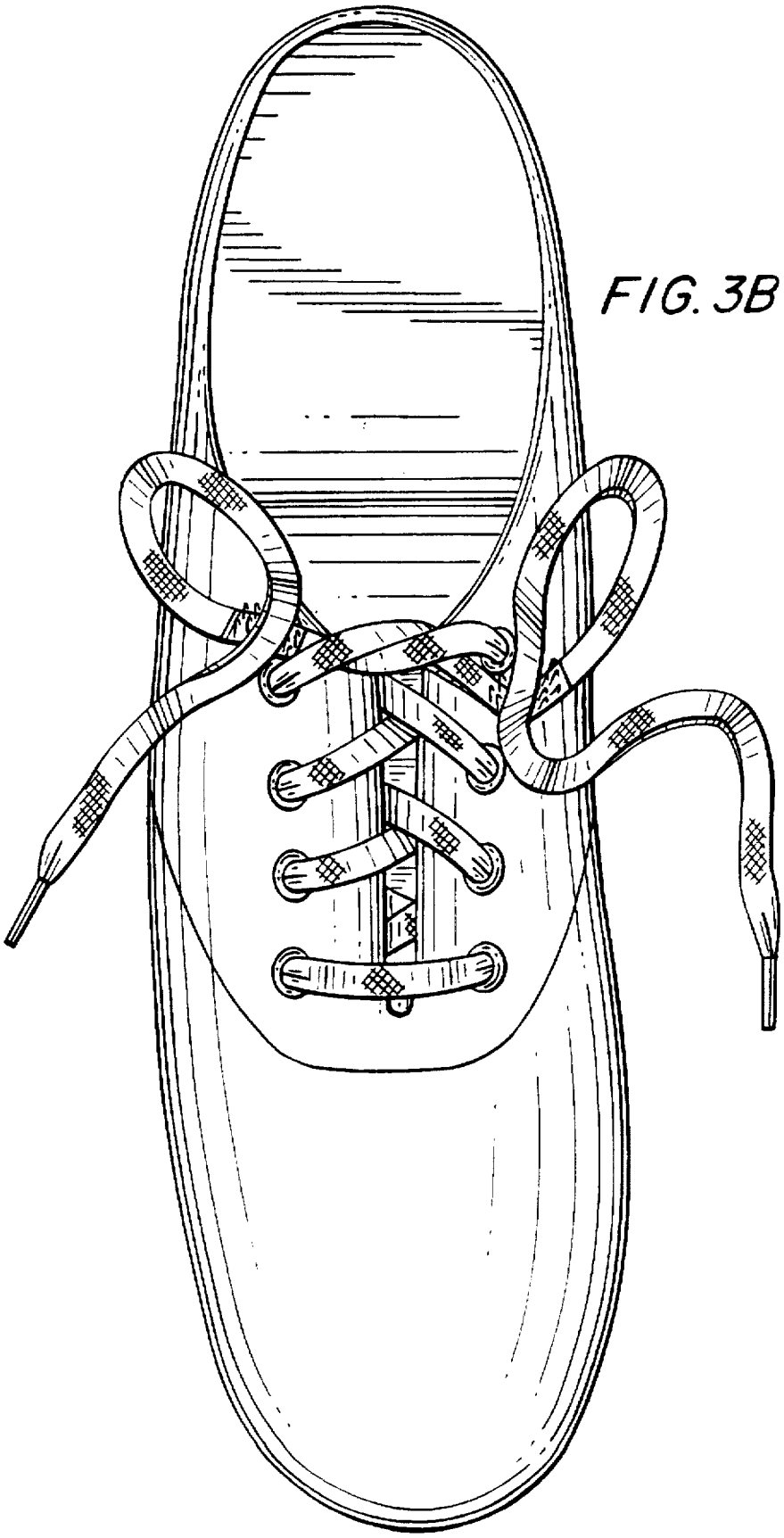

In one embodiment of the binding, the first regions are proximal to the extreme ends of the binding and the second regions are distal to the extreme ends. (See e.g., FIG. 3A) In another embodiment, the first regions are distal to the extreme ends of the binding and the second regions are proximal to the extreme ends (See e.g., FIG. 3B).

In an embodiment of the binding, the section capable of adhering to the hook-shaped filaments comprises a VELCRO loop pad positioned on each end portion at a suitable distance from the hook fastener. However, it is preferred that the entire end portion of the binding other than the first region is a material capable of adhering to the hook-shaped filaments. In another embodiment the VELCRO loop pad is not present on the binding. For example, the binding may be a woven material wherein the weave is sufficiently loose so that it is adapted for adhering to the hook-shaped filaments.

In a preferred embodiment, the binding is a strap or lace, for example a shoelace. Various types of shoelaces and the construction of such are known to those skilled in the art.

This invention also provides a combination shoe and the binding described herein, comprising: a shoe having eyelets for passing a shoelace; and the above-described binding threaded through the eyelets of the shoe.

This invention also provides a method of tying a bow using a binding having two end portions wherein a multiplicity of hook-shaped filaments are positioned on a first region of each end portion; and a second region of each end portion is adapted for adhering to the hook-shaped filaments positioned on the same end portion so as to form a loop at each end portion, comprising: crossing the end portions to form a first opening; pulling the first end portion through the first opening while simultaneously pulling on the second end portion; at each end portion, contacting the multiplicity of hook-shaped filaments to the region capable of adhering to the hook-shaped filaments so as to form two loops; crossing the two loops so as to form a second opening; and pulling one loop thought the second opening while simultaneously pulling on the other loop, thereby completing the bow knot.

This invention provides a method of learning to tie a shoelace comprising the above-described method of tying a bow.

EXAMPLE 1

Figure 1A:
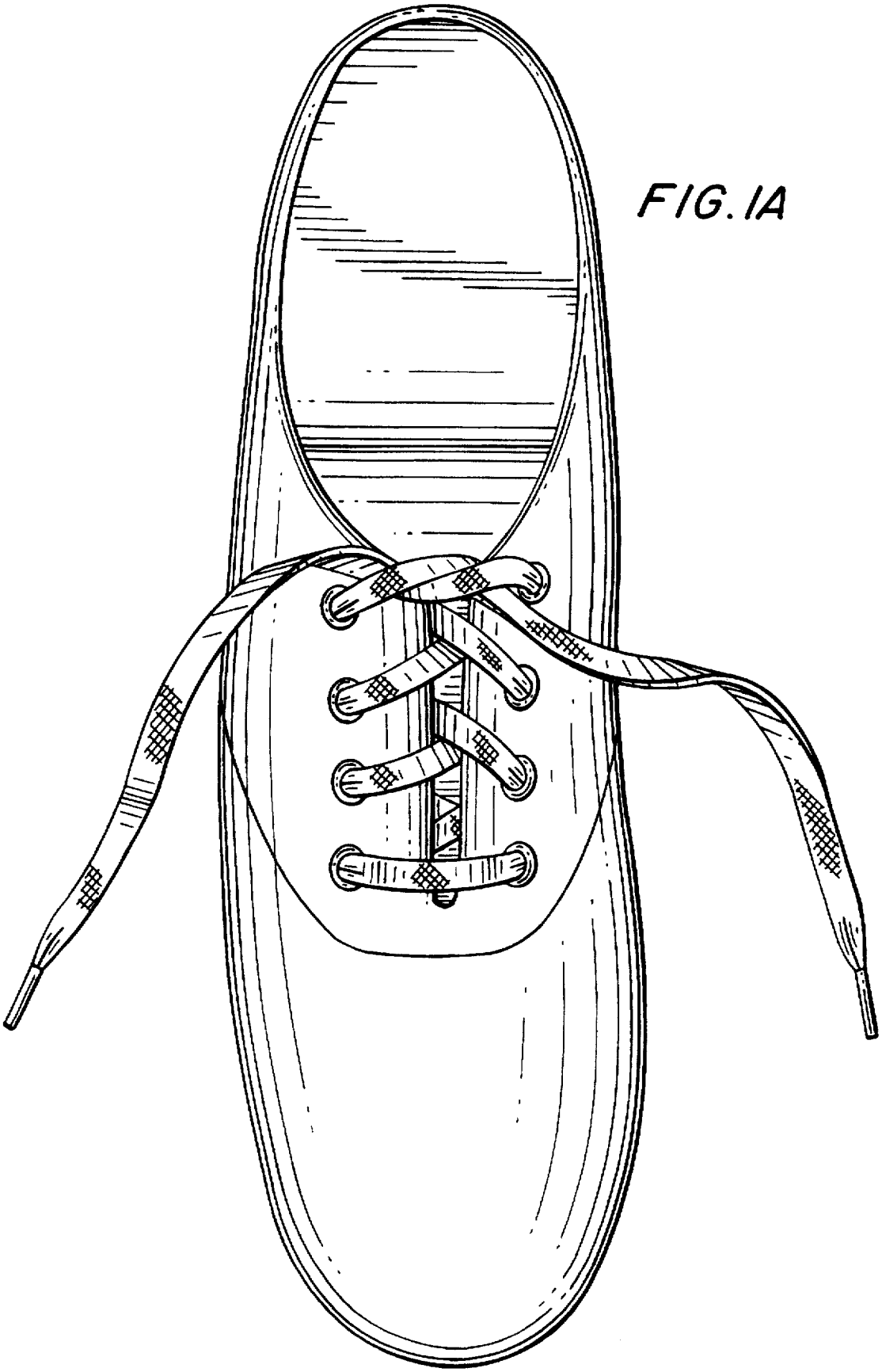
Figure 1B:
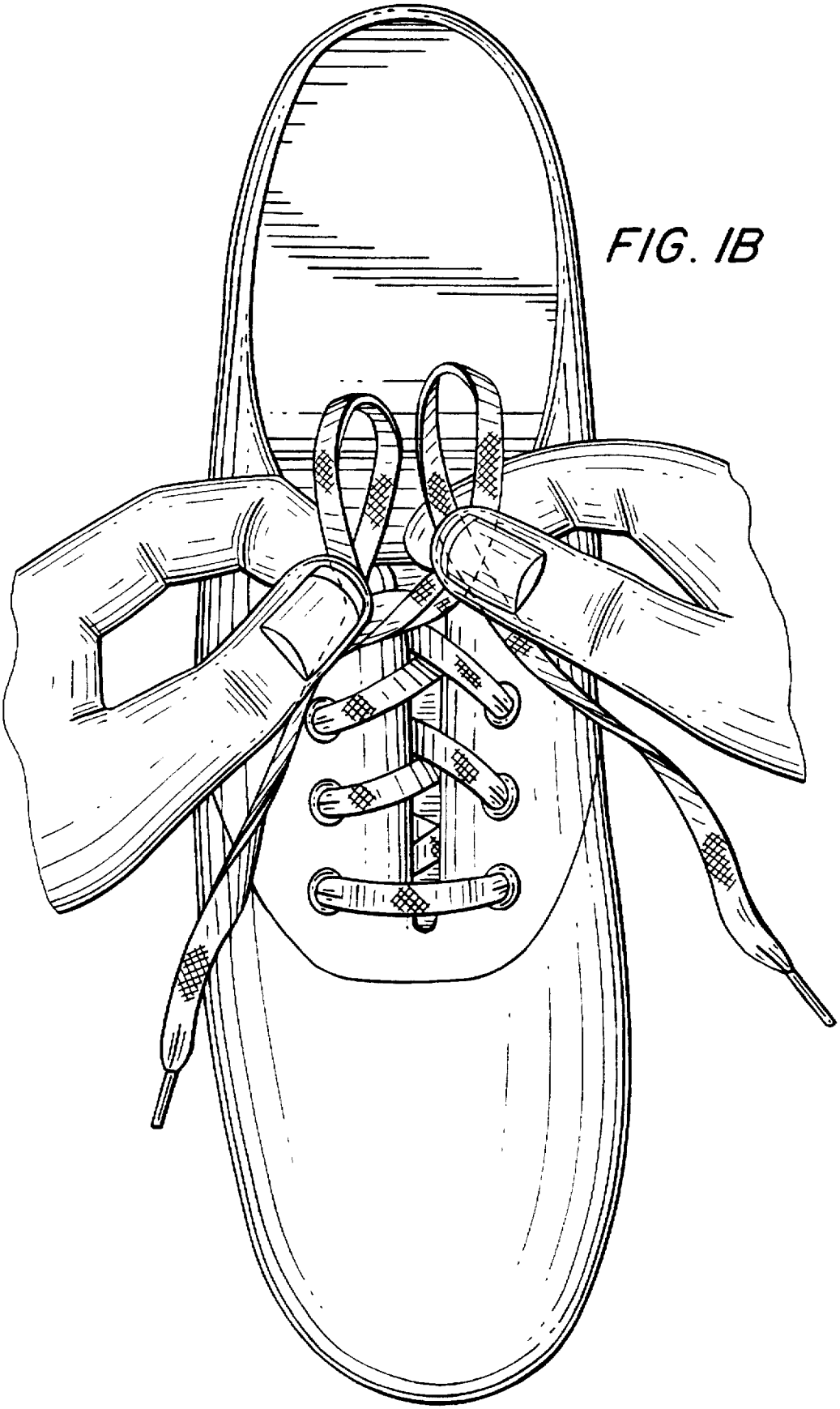
Figure 1C:
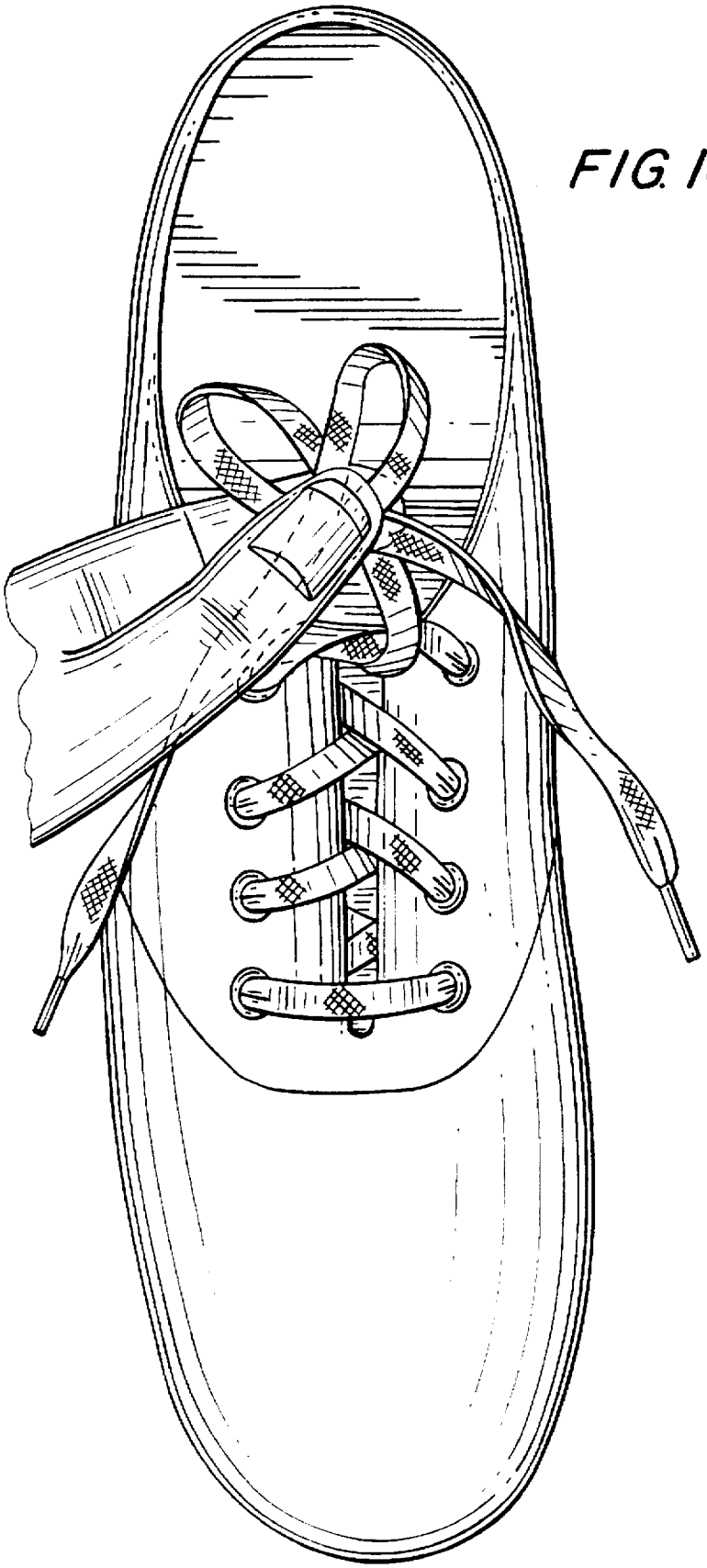
Figure 1D:
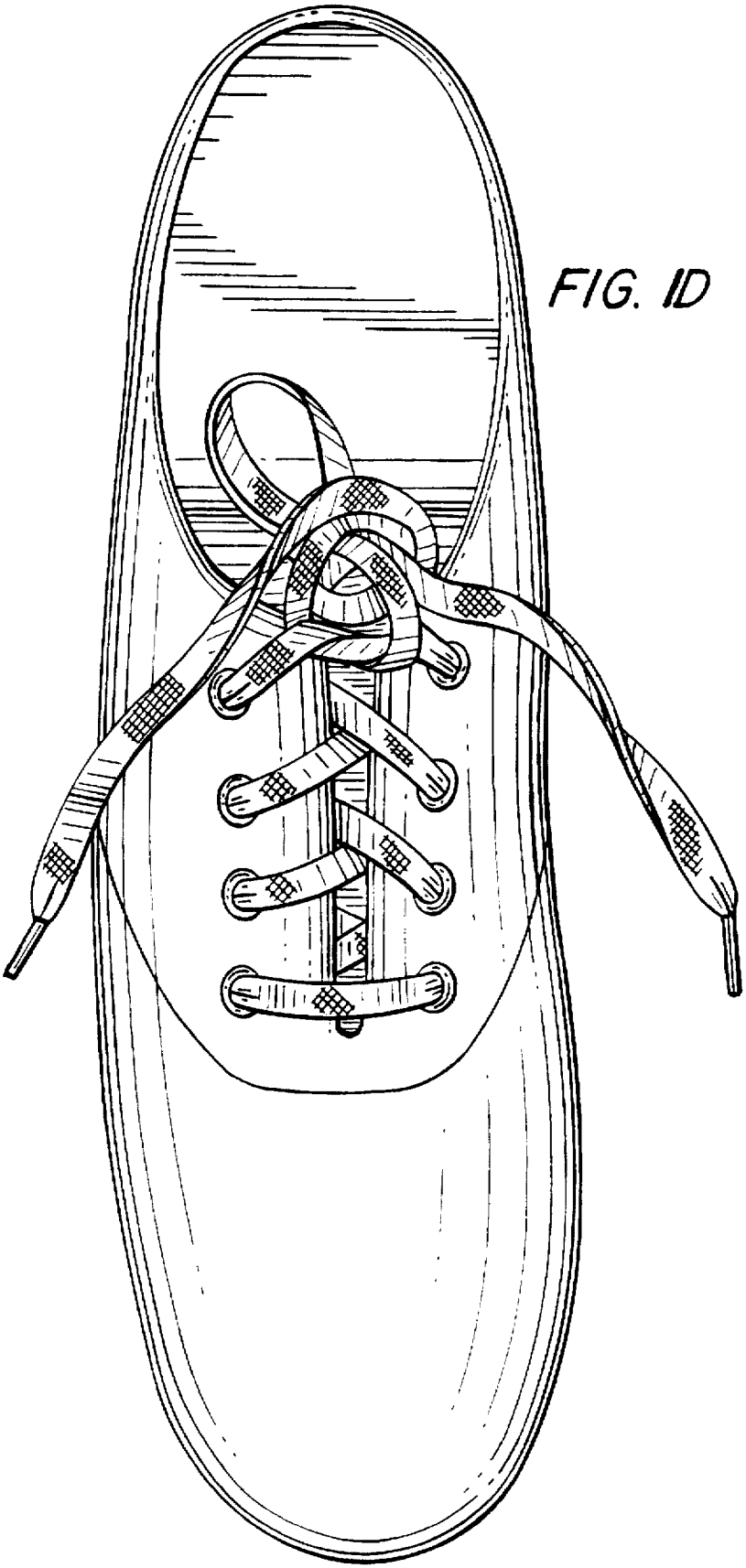
Figure 2:
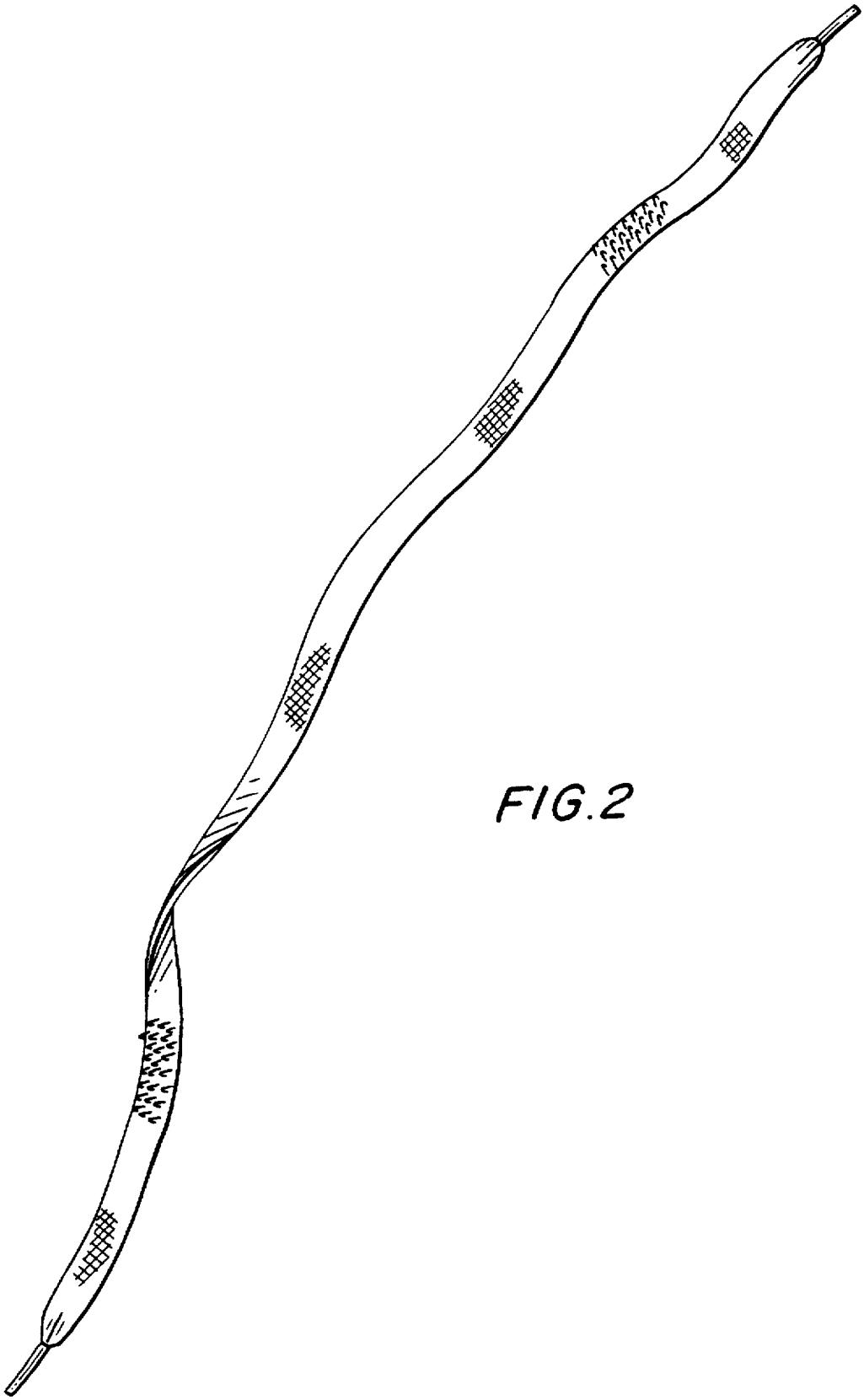

Using the shoelace shown in FIG. 2, developmentally delayed children learning to tie their shoes were able to VELCRO the loop into place, thus maintaining the shape of the loop without requiring finger stabilization. As the children practiced tying their shoelaces, they did not have to constantly revert back to the first stage but rather were able to immediately review the last step as the loops were still formed. Many of the children who mastered tying their shoes using the shoelaces with VELCRO were then able to generalize the skill to conventional laces without the VELCRO.

What is claimed is:

1. A shoelace consisting of a flexible, nonmetallic binding having two end portions wherein a multiplicity of hook-shaped filaments are positioned on a first region of each end portion; and a second region of each end portion for adhering to the hook-shaped filaments the same end portion so as to form a loop at each end portion; wherein the first region is proximal to the extreme ends of the binding and the second region is distal to the extreme ends of the binding; wherein the binding is of a woven material in which the weave is sufficiently loose for adhering to the hookshaped filaments, and in which a VELCRO loop and is not present on the binding.

2. The binding of claim 1, wherein the hook-shaped filaments comprise a VELCRO hook pad.

3. The binding of claim 1, wherein the second region comprises a multiplicity of loop shaped filaments.

4. The binding of claim 1, wherein the first regions are distal to the extreme ends of the binding and the second regions are proximal to the extreme ends.

5. The binding of claim 1, wherein the binding is a shoelace strap or lace.

* * * * *